US008112022B2

(12) United States Patent
Okamoto et al.

(10) Patent No.: US 8,112,022 B2
(45) Date of Patent: Feb. 7, 2012

(54) FIXING DEVICE, IMAGE FORMING APPARATUS, AND IMAGE FIXING METHOD CAPABLE OF STABLY APPLYING OIL FOR FIXING WITHOUT ADHERING OIL TO SHEET

(75) Inventors: Masami Okamoto, Yamato (JP); Jun Okamoto, Kawasaki (JP); Kazuo Suno, Mito (JP); Kenji Nozawa, Hitachinaka (JP); Naoto Suzuki, Hitachinaka (JP); Yoshihiro Sonohara, Hitachi (JP); Syoichi Kaneko, Ishioka (JP); Takashi Kagami, Mito (JP); Keisuke Kubota, Hitachineke (JP); Hiroyuki Shimada, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 133 days.

(21) Appl. No.: 12/453,189

(22) Filed: May 1, 2009

(65) Prior Publication Data

US 2009/0274496 A1 Nov. 5, 2009

(30) Foreign Application Priority Data

May 2, 2008 (JP) ..... 2008-120434

(51) Int. Cl.
*G03G 15/20* (2006.01)

(52) U.S. Cl. ..... 399/325; 399/67; 399/122; 399/324; 399/328

(58) Field of Classification Search ..... 399/67, 399/122, 324, 325, 328
See application file for complete search history.

(56) References Cited

U.S. PATENT DOCUMENTS 3,999,510 A 12/1976 Thettu
(Continued)

FOREIGN PATENT DOCUMENTS

JP 03038680 A * 2/1991
(Continued)

OTHER PUBLICATIONS

Abstract of JP 03038680 A to Kato et al.*
(Continued)

*Primary Examiner* — Ryan Walsh
(74) *Attorney, Agent, or Firm* — Harness, Dickey & Pierce, P.L.C.

(57) ABSTRACT

In a fixing device, a controller switches a pressing member between a pressure application state to contact the pressing member against a fixing member and a pressure release state to separate the pressing member from the fixing member. The controller starts rotation of the pressing member before the pressing member contacts the fixing member in the pressure application state, when the pressing member switches from the pressure release state to the pressure application state. An oil applier includes an oil pan and an oil regulating member. The oil pan is provided under the pressing member to contain oil in which the pressing member is dipped. The oil regulating member is provided downstream from the oil pan in a direction of rotation of the pressing member to contact the pressing member to regulate an amount of oil adhering to the pressing member.

19 Claims, 9 Drawing Sheets

U.S. PATENT DOCUMENTS

| | | | | |
|---|---|---|---|---|
| 4,231,653 | A | 11/1980 | Nagahara et al. | |
| 4,287,280 | A | 9/1981 | Swift | |
| 4,770,116 | A | 9/1988 | Moser | |
| 5,300,996 | A | 4/1994 | Yokoyama et al. | |
| 5,543,904 | A | 8/1996 | Kato et al. | |
| 5,678,149 | A | 10/1997 | Takekoshi et al. | |
| 5,678,153 | A | 10/1997 | Okamoto et al. | |
| 5,679,462 | A | 10/1997 | Soga et al. | |
| 5,768,655 | A | 6/1998 | Yoshino et al. | |
| 6,360,072 | B1 | 3/2002 | Costrop et al. | |
| 6,621,928 | B1 | 9/2003 | Inagaki et al. | |
| 6,647,221 | B1 | 11/2003 | Furuyama | |
| 6,980,762 | B2 | 12/2005 | Bogoshian | |
| 7,164,878 | B2 | 1/2007 | Yamanaka | |
| 7,509,085 | B2 | 3/2009 | Yoshinaga et al. | |
| 8,027,627 | B2 | 9/2011 | Okamoto et al. | |
| 2002/0044805 | A1 | 4/2002 | Hasegawa | |
| 2002/0176724 | A1* | 11/2002 | Fuma et al. | 399/328 |
| 2003/0095806 | A1 | 5/2003 | Wu et al. | |
| 2005/0123327 | A1* | 6/2005 | Tateishi et al. | 399/325 |
| 2006/0165443 | A1 | 7/2006 | Yoshinaga et al. | |
| 2006/0177232 | A1 | 8/2006 | Ehara et al. | |
| 2006/0198646 | A1 | 9/2006 | Funabiki et al. | |
| 2007/0237554 | A1 | 10/2007 | Mitsuya et al. | |
| 2008/0013995 | A1 | 1/2008 | Kubota et al. | |
| 2008/0170896 | A1 | 7/2008 | Kubota et al. | |
| 2009/0274498 | A1 | 11/2009 | Okamoto et al. | |

FOREIGN PATENT DOCUMENTS

| | | |
|---|---|---|
| JP | 04-257885 | 9/1992 |
| JP | 5-027648 | 2/1993 |
| JP | 7-160141 | 6/1995 |
| JP | 9-319243 | 12/1997 |
| JP | 2000-241117 | 9/2000 |
| JP | 2003-015461 | 1/2003 |
| JP | 2005-055810 | 3/2005 |
| JP | 2008-046663 | 2/2008 |
| JP | 2008-065349 | 3/2008 |
| JP | 4115733 | 4/2008 |

OTHER PUBLICATIONS

Abstract of JP 2003-302857 published on Oct. 24, 2003.
Office Action dated Aug. 4, 2011 for corresponding U.S. Appl. No. 12/453,193.
Office Action dated Jan. 10, 2011 for corresponding U.S. Appl. No. 12/434,195.
Office Action dated Jan. 4, 2011 for corresponding U.S. Appl. No. 12/434,213.
Office Action dated May 17, 2011 for corresponding U.S. Appl. No. 12/434,288.
Office Action dated Dec. 21, 2010 for corresponding U.S. Appl. No. 12/434,288.
Office Action dated Aug. 17, 2011 for corresponding U.S. Appl. No. 12/434,223.
Office Action dated Dec. 14, 2011 for corresponding U.S. Appl. No. 12/453,193.

* cited by examiner

FIXING DEVICE, IMAGE FORMING APPARATUS, AND IMAGE FIXING METHOD CAPABLE OF STABLY APPLYING OIL FOR FIXING WITHOUT ADHERING OIL TO SHEET

PRIORITY STATEMENT

The present patent application claims priority from Japanese Patent Application No. 2008-120434, filed on May 2, 2008, in the Japan Patent Office, the entire contents of which are hereby incorporated herein by reference.

BACKGROUND OF THE INVENTION

1. Field of the Invention

Example embodiments generally relate to a fixing device, an image forming apparatus, and an image fixing method, and more particularly, to a fixing device, an image forming apparatus including the fixing device, and an image fixing method for fixing a toner image on a recording medium.

2. Description of the Related Art

Related-art image forming apparatuses, such as copiers, facsimile machines, printers, or multifunction printers having at least one of copying, printing, scanning, and facsimile functions, typically form an image on a recording medium (e.g., a sheet) according to image data using electrophotography. Thus, for example, a charger uniformly charges a surface of an image carrier; an optical writer emits a light beam onto the charged surface of the image carrier to form an electrostatic latent image on the image carrier according to the image data; a development device supplies toner particles to the electrostatic latent image formed on the image carrier to make the electrostatic latent image visible as a toner image; the toner image is directly transferred from the image carrier onto a sheet or is indirectly transferred from the image carrier onto a sheet via an intermediate transfer member; a cleaner then cleans the surface of the image carrier after the toner image is transferred from the image carrier onto the sheet; finally, a fixing device applies heat and pressure to the sheet bearing the toner image to fix the toner image on the sheet, thus forming the image on the sheet.

In such image forming apparatuses, oil is applied to a fixing member of the fixing device, which contacts the toner image on the sheet, to separate toner particles forming the toner image from the fixing member and to maintain fixing property, or the ability of the fixing member to fix the toner image on the sheet. Understanding the way in which the oil is applied requires a detailed discussion of the structure of a typical conventional fixing device.

In order to shorten a warm-up time period of the fixing device, an endless fixing belt is often used as the fixing member. FIG. 1 is a sectional view of a fixing device 100RA including just such an endless fixing belt.

As can be seen in FIG. 1, the fixing device 100RA loops an endless fixing belt 92 around a fixing roller 84 and a heating roller 83 in such a manner that the fixing roller 84 and the heating roller 83 apply a reference tension to the fixing belt 92. A pressing roller 85 rotates and presses against the fixing belt 92 and the fixing roller 84 to form a fixing nip portion AR between the fixing belt 92 and the pressing roller 85. A heater 86 is disposed inside the heating roller 83, and heats the fixing belt 92 via the heating roller 83. Similarly, a second, separate heater 87 is disposed inside the pressing roller 85, and heats the pressing roller 85. The fixing belt 92 and the pressing roller 85 apply heat and pressure to a sheet bearing a toner image at the fixing nip portion AR to fix the toner image on the sheet.

An oil application roller R1 serves as an oil applier for applying oil to the fixing belt 92. For example, the rotating oil application roller R1 applies oil supplied from an oil supplier to the fixing belt 92 at a contact point 95 at which the oil application roller R1 contacts the fixing belt 92. The rotating fixing belt 92 moves an oiled portion of the fixing belt 92 to which oil is applied to the fixing nip portion AR to separate the sheet bearing the toner image from the fixing belt 92. At the fixing nip portion AR, a part of the oil on the fixing belt 92 moves from the fixing belt 92 onto a surface of the pressing roller 85 to separate the sheet bearing the toner image from the pressing roller 85. Surplus oil carried on the pressing roller 85 then flows into an oil pan 96 provided under the pressing roller 85, and is collected by the oil pan 96.

However, not enough oil may adhere to the pressing roller 85, and consequently a sheet bearing a fixed toner image may not separate cleanly from the pressing roller 85. For example, when a plurality of sheets continuously passes through the fixing nip portion AR, oil can only move from the fixing belt 92 onto the pressing roller 85 during an interval between successive sheets, resulting in a shortage of oil.

To prevent or reduce such shortage of oil on the pressing roller 85, another oil applier may be provided for the pressing roller 85 to apply oil to the pressing roller 85. However, the oil thus applied to the pressing roller 85 may adhere to a foremost sheet fed into the fixing device 100RA immediately after the fixing device 100RA is driven.

On the other hand, gravity can easily cause a sheet passing through the fixing nip portion AR to adhere to or wrap around the pressing roller 85 at an exit side of the fixing nip portion AR.

To address these problems, another related-art fixing device 100RB includes an oil applier R3 for applying oil to the pressing roller 85 by directly contacting the pressing roller 85, as illustrated in FIG. 2. However, the oil applier R3 may not apply an amount of oil sufficient to form a toner image at high linear speed or to separate coated paper, which absorbs oil easily, from the pressing roller 85. Moreover, it is difficult to locate an oil applier capable of applying a substantial amount of oil to the pressing roller 85 at a position above the pressing roller 85 due to limited space.

SUMMARY

At least one embodiment may provide a fixing device that includes a rotatable fixing member, a rotatable pressing member provided under the fixing member, a controller, and an oil applier. The controller switches the pressing member between a pressure application state to contact the pressing member against the fixing member and a pressure release state to separate the pressing member from the fixing member. The controller starts rotation of the pressing member before the pressing member contacts the fixing member in the pressure application state, when the pressing member switches from the pressure release state to the pressure application state. The oil applier includes an oil pan and an oil regulating member. The oil pan is provided under the pressing member to contain oil in which the pressing member is dipped. The oil regulating member is provided downstream from the oil pan in a direction of rotation of the pressing member to contact the pressing member to regulate an amount of oil adhering to the pressing member.

At least one embodiment may provide an image forming apparatus that includes a fixing device including a rotatable fixing member, a rotatable pressing member provided under the fixing member, a controller, and an oil applier. The controller switches the pressing member between a pressure application state to contact the pressing member against the fixing member and a pressure release state to separate the pressing member from the fixing member. The controller starts rotation of the pressing member before the pressing member contacts the fixing member in the pressure application state, when the pressing member switches from the pressure release state to the pressure application state. The oil applier includes an oil pan and an oil regulating member. The oil pan is provided under the pressing member to contain oil in which the pressing member is dipped. The oil regulating member is provided downstream from the oil pan in a direction of rotation of the pressing member to contact the pressing member to regulate an amount of oil adhering to the pressing member.

At least one embodiment may provide an image fixing method that includes applying oil to a pressing member, regulating an amount of oil adhering to the pressing member, contacting the pressing member against a fixing member after the pressing member rotates by at least a half turn. The image fixing method further includes contacting a separation nail against the pressing member when the pressing member contacts the fixing member, and switching the pressing member between a pressure application state, in which the pressing member is contacted against the fixing member, and a pressure release state, in which the pressing member is separated from the fixing member.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
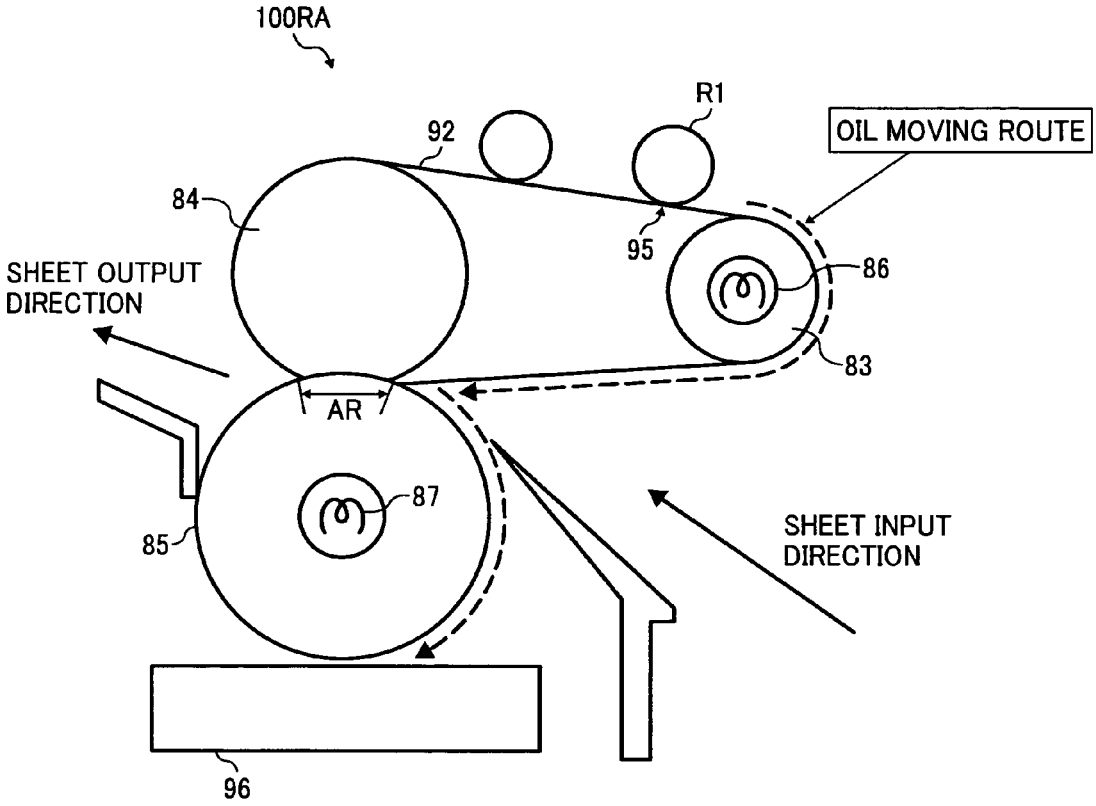
FIG. 1 is a sectional view of a related-art fixing device.
Figure 2:
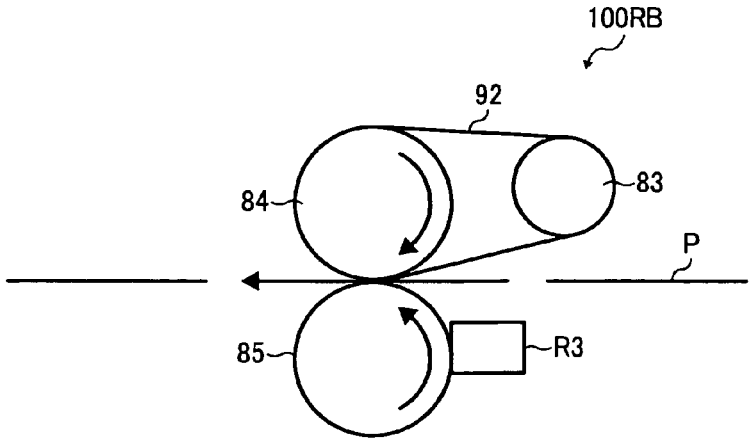
FIG. 2 is a sectional view of another related-art fixing device.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 3:
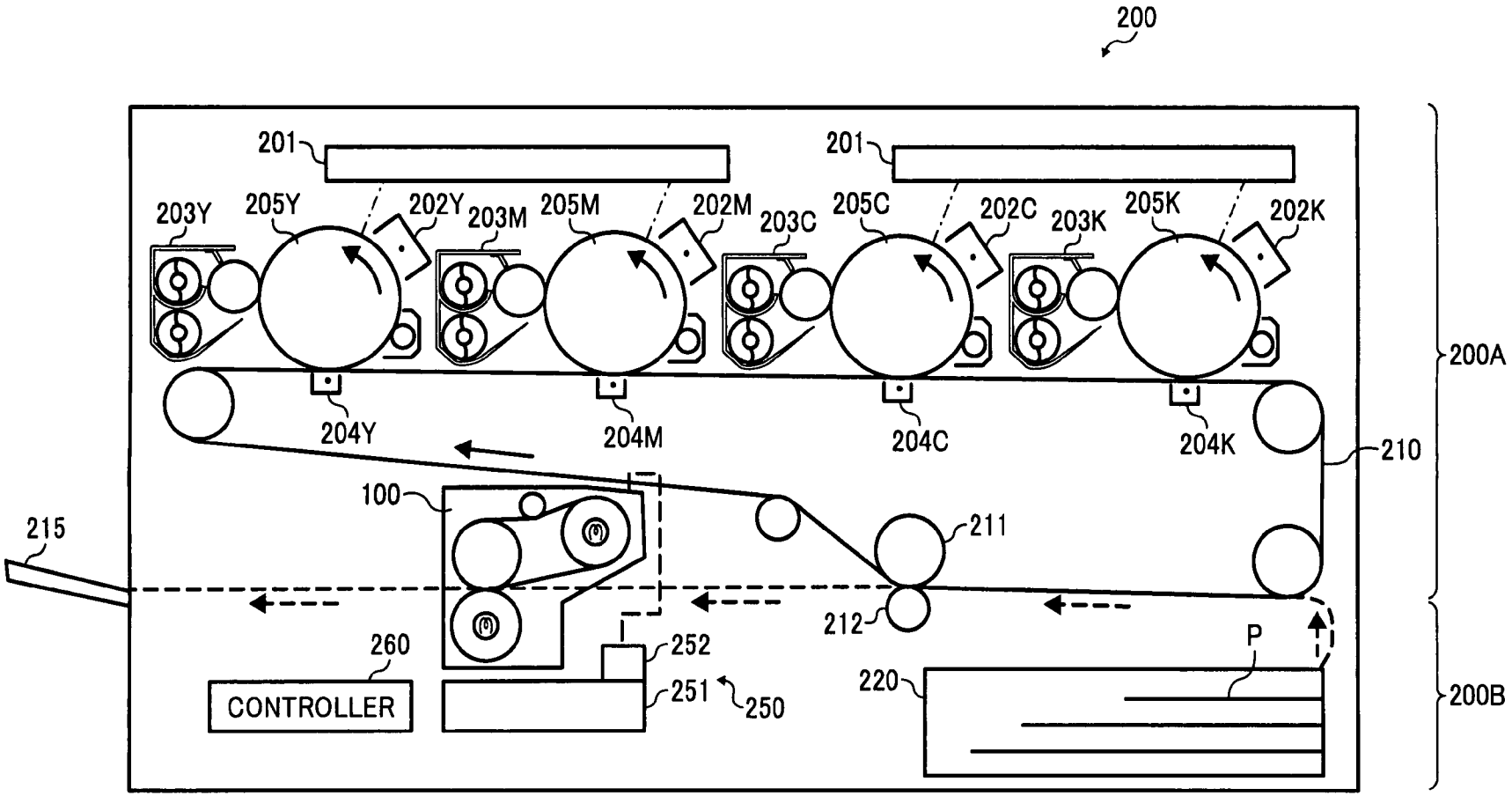
FIG. 3 is a sectional view of an image forming apparatus according to an example embodiment.

Referring now to the drawings, wherein like reference numerals designate identical or corresponding parts throughout the several views, particularly to FIG. 3, an image forming apparatus 200 according to an example embodiment is explained.

As illustrated in FIG. 3, the image forming apparatus 200 includes an image forming device 200A, a sheet supplier 200B, a stacker 215, and/or a controller 260.

The image forming device 200A includes optical writers 201, chargers 202Y, 202M, 202C, and 202K, development devices 203Y, 203M, 203C, and 203K, first transfer devices 204Y, 204M, 204C, and 204K, photoconductors 205Y, 205M, 205C, and 205K, a transfer belt 210, a roller 211, a transfer roller 212, a fixing device 100, and/or an oil circulation mechanism 250. The sheet supplier 200B includes a paper tray 220. The oil circulation mechanism 250 includes an oil tank 251 and/or an oil pump 252.

The image forming apparatus 200 can be a copier, a facsimile machine, a printer, a plotter, a multifunction printer having at least one of copying, printing, scanning, plotter, and facsimile functions, or the like. According to this example embodiment of the present invention, the image forming apparatus 200 functions as a tandem type color copier for forming a color image on a recording medium at high speed by electrophotography.

The image forming device 200A is provided at a center portion of the image forming apparatus 200. The sheet supplier 200B is provided under the image forming device 200A. An image reader is provided above the image forming device 200A.

In the image forming device 200A, the transfer belt 210 includes a transfer surface extending in a horizontal direction. A mechanism for forming an image in a complementary color being complementary to a separation color is provided above the transfer belt 210. For example, the photoconductors 205Y, 205M, 205C, and 205K, serving as image carriers for carrying toner images in complementary colors (e.g., yellow, magenta, cyan, and black), are arranged along the transfer surface of the transfer belt 210.

The photoconductors 205Y, 205M, 205C, and 205K are formed of drums which rotate in an identical direction (e.g., counterclockwise in FIG. 3), respectively. The optical writers 201, the chargers 202Y, 202M, 202C, and 202K, the development devices 203Y, 203M, 203C, and 203K, the first transfer devices 204Y, 204M, 204C, and 204K, and cleaners surround the photoconductors 205Y, 205M, 205C, and 205K, respectively, to perform image forming processes while the photoconductors 205Y, 205M, 205C, and 205K rotate. The development devices 203Y, 203M, 203C, and 203K contain yellow, magenta, cyan, and black toners, respectively.

The transfer belt 210 is looped over a driving roller and a driven roller, and opposes the photoconductors 205Y, 205M, 205C, and 205K to move in a direction corresponding to the direction of rotation of the photoconductors 205Y, 205M, 205C, and 205K. The transfer roller 212 opposes the roller 211 serving as a driven roller.

In the sheet supplier 200B, the paper tray 220 loads sheets P serving as a recording medium. A conveyance mechanism feeds the sheets P loaded on the paper tray 220 one by one toward the transfer roller 212. For example, the conveyance mechanism separates an uppermost sheet P from other sheets P loaded on the paper tray 220, and conveys the sheet P toward the transfer roller 212. A conveyance path provided between the transfer roller 212 and the fixing device 100 conveys the sheet P in a horizontal direction. The controller 260 controls operations of the image forming apparatus 200.

The following describes image forming operations performed by the image forming apparatus 200. The charger 202Y uniformly charges a surface of the photoconductor 205Y. The optical writer 201 forms an electrostatic latent image on the charged surface of the photoconductor 205Y according to image data sent by the image reader. The development device 203Y for containing the yellow toner makes the electrostatic latent image formed on the photoconductor 205Y visible as a yellow toner image. The first transfer device 204Y applies a reference bias to the yellow toner image formed on the photoconductor 205Y to transfer the yellow toner image onto the transfer belt 210. Similarly, magenta, cyan, and black toner images are formed on the photoconductors 205M, 205C, and 205K, respectively, and sequentially transferred onto the transfer belt 210 by an electrostatic force so that the yellow, magenta, cyan, and black toner images are superimposed on the transfer belt 210 to form a color toner image on the transfer belt 210.

The transfer roller 212 transfers the color toner image from the transfer belt 210 onto the sheet P conveyed by the roller 211 and the transfer roller 212. The sheet P bearing the color toner image is further conveyed to the fixing device 100. The fixing device 100 fixes the color toner image on the sheet P. The sheet P bearing the fixed color toner image is sent to the stacker 215 via an output path.

The oil tank 251 collects oil used in the fixing device 100 to improve property for separating the sheet P from the fixing device 100. The oil pump 252 resupplies oil contained in the oil tank 251 to the fixing device 100. The oil tank 251 and the oil pump 252 serve as the oil circulation mechanism 250 (e.g., an oil circulation system) provided for the fixing device 100.

Figure 4:
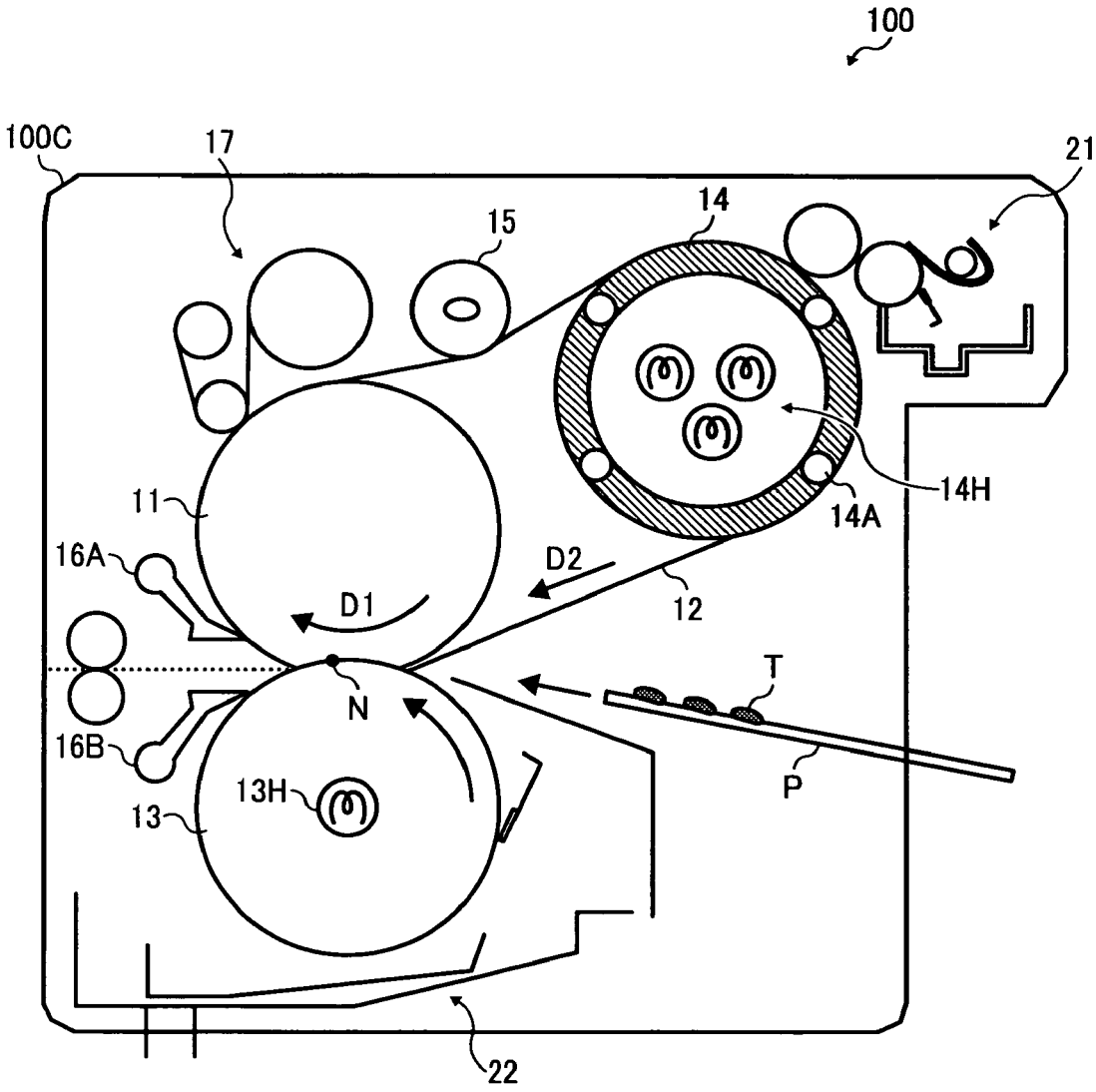
FIG. 4 is a sectional view (according to an example embodiment) of a fixing device -included in the image forming apparatus shown in FIG. 3.

FIG. 4 is a sectional view of the fixing device 100. The fixing device 100 includes a fixing cover 100C, a fixing roller 11, a fixing belt 12, a pressing roller 13, a heater 13H, a heating roller 14, a heat pipe 14A, a heater 14H, a tension roller 15, separation nails 16A and 16B, a cleaning mechanism 17, and/or oil appliers 21 and 22.

The fixing roller 11, the fixing belt 12, the pressing roller 13, the heating roller 14, the separation nails 16A and 16B, and the cleaning mechanism 17 are provided inside the fixing cover 100C. The fixing belt 12, serving as a fixing member, is looped or stretched over the fixing roller 11 and the heating roller 14 with a reference tension. The pressing roller 13, serving as a pressing member, is provided under the fixing belt 12 and rotatably presses against the fixing belt 12 to form a fixing nip portion N between the fixing belt 12 and the pressing roller 13. The fixing belt 12 and the pressing roller 13 apply heat and pressure to a sheet P bearing a toner image T at the fixing nip portion N to fix the toner image T on the sheet P. The separation nail 16A is provided at an exit side of the fixing nip portion N in such a manner that a head of the separation nail 16A contacts or is disposed close to the fixing belt 12, so as to prevent a sheet P from wrapping around the fixing belt 12. The separation nail 16B is provided at the exit side of the fixing nip portion N in such a manner that a head of the separation nail 16B contacts the pressing roller 13, so as to prevent a sheet P from wrapping around the pressing roller 13. The cleaning mechanism 17 cleans the fixing belt 12 by pressing a cleaning web against the fixing belt 12.

The fixing belt 12 has an endless belt shape and has a double-layer structure in which an elastic layer, such as a silicon rubber layer, is formed on a base including nickel, stainless steel, and/or polyimide. The fixing roller 11 includes metal serving as a core metal and silicon rubber. In order to shorten a warm-up time period of the fixing device 100, the fixing roller 11 may include foamed silicon rubber so that the fixing roller 11 does not absorb heat from the fixing belt 12 easily. The heating roller 14 is formed of a hollow roller including aluminum or iron. The heater 14H, such as a halogen heater, serves as a heat source and is provided inside the heating roller 14. Alternatively, an induction heating (IH) mechanism may serve as the heat source. A plurality of heat pipes 14A, which is formed of hollow pipes, is provided in a thick wall of the heating roller 14. For example, the heat pipes 14A are embedded in the thick wall of the heating roller 14 in such a manner that the heat pipes 14A are evenly spaced in a circumferential direction of the heating roller 14 and that a longitudinal direction of the heat pipes 14A corresponds to a longitudinal direction (e.g., a width direction or an axial direction) of the heating roller 14. The heat pipes 14A improve heat transmission from the heater 14H to a surface of the heating roller 14, and thereby the heating roller 14 uniformly,heats the fixing belt 12 quickly.

When the fixing device 100 is driven, a driving force input from an outside of the fixing device 100 drives and rotates the pressing roller 13 counterclockwise in FIG. 4, for example. Accordingly, the rotating pressing roller 13 rotates the fixing roller 11 clockwise in FIG. 4 in a direction of rotation D1 via the fixing belt 12. For example, in a state in which the tension roller 15 presses against the fixing belt 12 to apply proper tension to the fixing belt 12, the fixing belt 12 rotates clockwise in FIG. 4 in a direction of rotation D2 in which the fixing belt 12 feeds a sheet P out of the fixing nip portion N. In order to fix a toner image T on a sheet P, the heater 14H provided inside the heating roller 14 generates heat to heat the fixing belt 12 until a thermistor detects that the fixing belt 12 is heated up to a reference temperature (e.g., a proper fixing temperature). According to this example embodiment, the fixing belt 12, that is, an endless belt, serves as a fixing member. Alternatively, a fixing roller, for example, a hollow cylindrical roller may serve as a fixing member.

The pressing roller 13 is formed of a cylindrical roller in which an elastic layer including silicon rubber is provided on a core metal including aluminum or iron. The heater 13H is provided inside the pressing roller 13, and generates heat to heat the pressing roller 13 up to a reference temperature as needed, for example, to fix a toner image T on a sheet P.

In the fixing device 100, the oil appliers 21 and 22 apply a proper amount of oil to the fixing belt 12 and the pressing roller 13, respectively, and the separation nails 16A and 16B, which are provided at the exit side of the fixing nip portion N, function as needed. Thus, a sheet P can be discharged to the exit side of the fixing nip portion N without adhering to or wrapping around the fixing belt 12 or the pressing roller 13.

Figure 5:
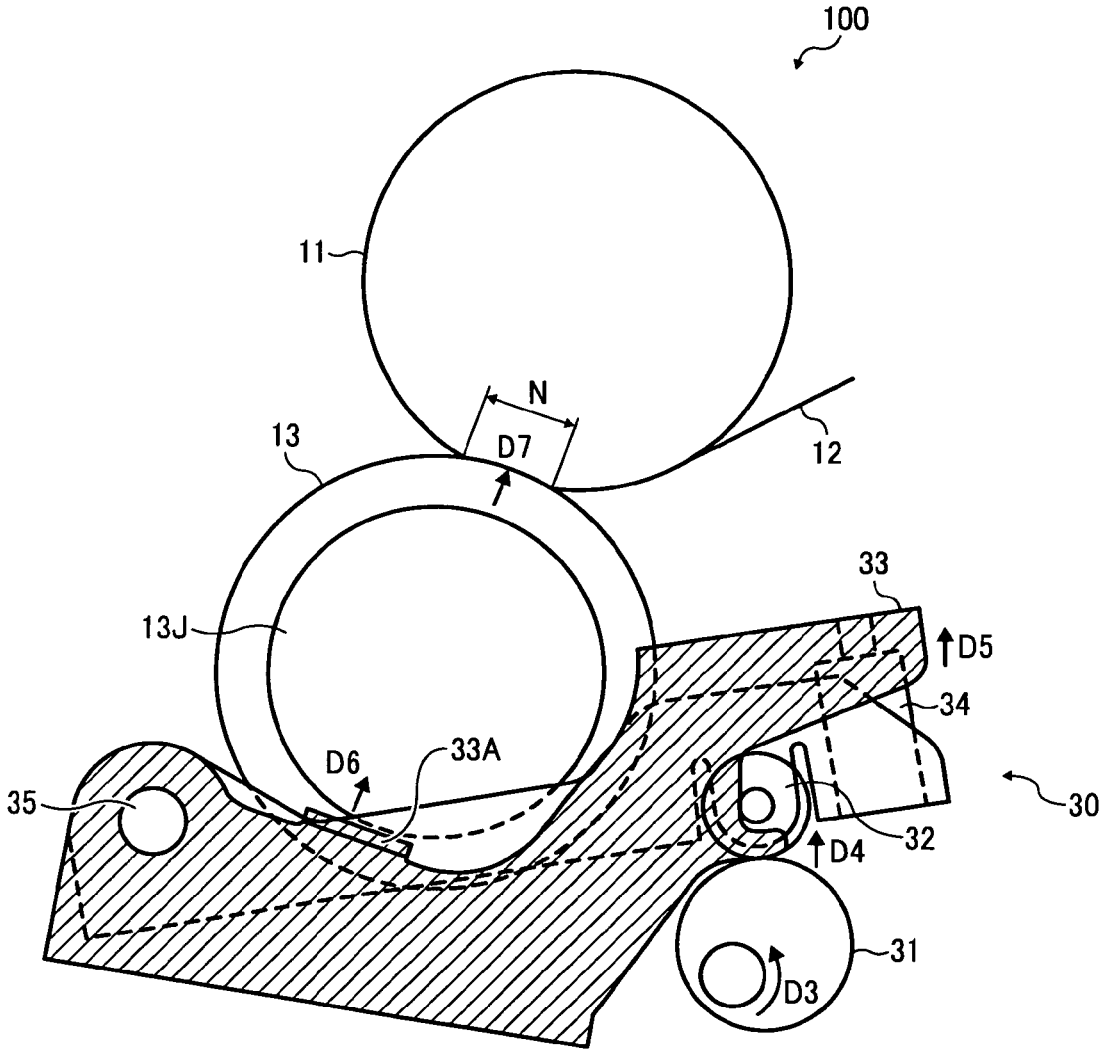
FIG. 5 is a sectional view (according to an example embodiment) of a pressure application-release device included in the fixing device shown in FIG. 4.

FIG. 5 is a partially sectional view of the fixing device 100. The fixing device 100 further includes a pressure application-release device 30. The pressure application-release device 30 includes a pressing cam 31, a first pressing arm 32, a second pressing arm 33, an elastic member 34, and/or a support shaft 35. The second pressing arm 33 includes a pressing portion 33A. The pressing roller 13 includes a shaft 13J.

The pressure application-release device 30 switches a state of the pressing roller 13 between a pressure application state in which the pressing roller 13, contacts the fixing belt 12 to apply pressure to the fixing belt 12 and a pressure release state in which the pressing roller 13 separates from the fixing belt 12 to release pressure applied to the fixing belt 12.

A driving force input from an outside of the pressure application-release device 30 rotates the pressing cam 31. The elastic member 34 is fixed to an end of each of the first pressing arm 32 and the second pressing arm 33. In FIG. 5, the second pressing arm 33 is shaded. The support shaft 35 is fixed to a frame of the fixing device 100, and supports the first pressing arm 32 and the second pressing arm 33.

Referring to FIG. 5, the following describes pressure application operations of the pressure application-release device 30 for applying pressure to the fixing belt 12 by moving the pressing roller 13 toward the fixing belt 12, and pressure release operations of the pressure application-release device 30 for releasing pressure applied to the fixing belt 12 by moving the pressing roller 13 away from the fixing belt 12.

The following describes the pressure application operations of the pressure application-release device 30. When a driving force transmitted-from the outside of the fixing device 100 rotates the pressing cam 31 by a reference angle of rotation in a direction of rotation D3, the pressing cam 31 pushes up a spinning top of the first pressing arm 32 in a direction D4.

When the spinning top of the first pressing arm 32 is pushed up, the first pressing arm 32 rotates about the support shaft 35 counterclockwise in FIG. 5. Simultaneously, the elastic member 34 fixed to an end of the first pressing arm 32 opposite another end of the first pressing arm 32, to which the support shaft 35 is attached, also rotates to push up a contact end of the second pressing arm 33, which contacts the elastic member 34, with reference pressure in a direction D5.

When the contact end of the second pressing arm 33 for contacting the elastic member 34 is pushed up, the second pressing arm 33 rotates about the support shaft 35 counterclockwise in FIG. 5.

Accordingly, the pressing portion 33A, which is provided between the contact end of the second pressing arm 33 for contacting the elastic member 34 and the support shaft 35, contacts the shaft 13J of the pressing roller 13 to push the pressing roller 13 toward the fixing roller 11 in a direction D6.

The pressing roller 13 presses against the fixing roller 11 via the fixing belt 12, and applies reference pressure based on an elastic force of the elastic member 34 to the fixing roller 11 in a direction D7 to form the fixing nip portion N between the fixing belt 12 and the pressing roller 13.

Thus, when the fixing device 100 is driven, the pressure application-release device 30 presses the pressing roller 13 against the fixing belt 12 by pushing the pressing roller 13 toward the fixing belt 12 with the reference pressure.

The following describes the pressure release operations of the pressure application-release device 30. When a driving force transmitted from the outside of the fixing device 100 rotates the pressing cam 31 further by a reference angle of rotation in the direction of rotation D3 from a position of the angle at which the pressing cam 31 causes the pressing roller 13 to press against the fixing roller 11 in the pressure application state, the pressing cam 31 releases pushing up the spinning top of the first pressing arm 32 in a direction opposite the direction D4.

When pushing up the first pressing arm 32 is released, the first pressing arm 32 rotates about the support shaft 35 in a direction of rotation opposite the direction of rotation during the pressure application operations, that is, clockwise in FIG. 5, with a repulsive force transmitted through the fixing nip portion N, the pressing portion 33A, and the elastic member 34. Accordingly, the contact end of the second pressing arm 33 corresponding to the elastic member 34 fixed to the end of the first pressing arm 32 opposite another end of the first pressing arm 32, to which the support shaft 35 is attached, is pulled together with the elastic member 34 in a direction opposite the direction during the pressure application operations, that is, in a direction opposite the direction D5.

When the contact end of the second pressing arm 33 for contacting the elastic member 34 is pulled down, the second pressing arm 33 rotates about the support shaft 35 in a direction of rotation opposite the direction of rotation during the pressure application operations, that is, clockwise in FIG. 5.

Accordingly, the pressing portion 33A, which is provided between the contact end of the second pressing arm 33 for contacting the elastic member 34 and the support shaft 35, moves in a direction in which the pressing portion 33A separates from the shaft 13J of the pressing roller 13 in a direction opposite the direction D6.

Thus, pressure applied by the pressing portion 33A to the pressing roller 13 is released, and the pressing roller 13 moves in a direction in which the pressing roller 13 separates from the fixing roller 11, that is, a direction opposite the direction D7. Accordingly, the fixing nip portion N is not formed between the fixing belt 12 and the pressing roller 13 in the pressure release state.

Thus, when driving of the fixing device 100 stops, the pressure application-release device 30 does not press the pressing roller 13 against the fixing belt 12, and the pressing roller 13 separates from the fixing belt 12 in the pressure release state.

As illustrated in FIG. 4, when the pressing roller 13 contacts the fixing belt 12 in the pressure application state, the separation nail 16B contacts the pressing roller 13. By contrast, when the pressing roller 13 separates from the fixing belt 12 in the pressure release state, the separation nail 16B separates from the pressing roller 13.

According to this example embodiment, the pressing roller 13 having a roller shape serves as a pressing member. Alternatively, an endless belt looped over at least two rollers may serve as a pressing member.

In the fixing device 100, a surface of the fixing belt 12 is heated up to a reference temperature in a state in which the fixing belt 12 and the pressing roller 13 are driven and rotated. When a sheet P bearing an unfixed toner image T passes through the fixing nip portion N, that is, when the sheet P moves leftward in FIG. 4, the fixing belt 12 and the pressing roller 13 apply heat and pressure to the sheet P at the fixing nip portion N to melt and fix the unfixed toner image T on the sheet P.

When the sheet P bearing the fixed toner image T is discharged from the fixing nip portion N, the sheet P may adhere to or wrap around the fixing belt 12 or the pressing roller 13. To address this, the oil appliers 21 and 22 apply oil to the fixing belt 12 and the pressing roller 13 to improve property for separating the sheet P from the fixing belt 12 and the pressing roller 13, respectively. The applied oil may be heat-resistant fixed oil, such as silicon oil. When the head of the separation nail 16A or 16B contacts a leading edge of the sheet P, the separation nail 16A or 16B separates the sheet P from the fixing belt 12 or the pressing roller 13, respectively. The sheet P discharged from the fixing nip portion N passes through a discharge path and is sent out of the fixing device 100.

Figure 6:
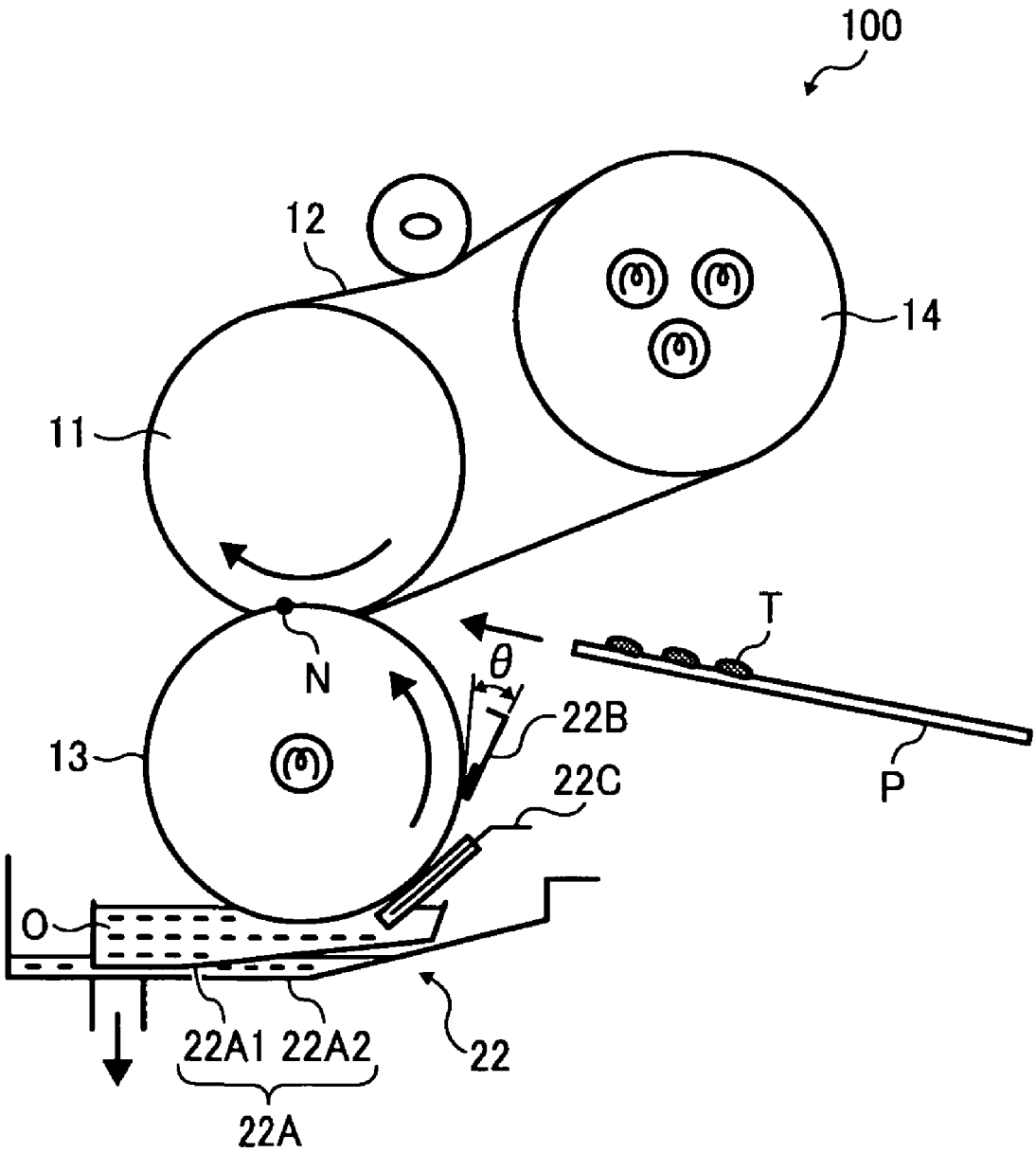
FIG. 6 is a sectional view (according to an example embodiment) of an oil applier included in the fixing device shown in FIG. 4.

FIG. 6 is a partially sectional view of the fixing device 100. The oil applier 22 includes an oil pan 22A, a blade 22B, and/or a cleaning felt 22C. The oil pan 22A includes a sub oil pan 22A1 and/or a main oil pan 22A2.

In the fixing device 100, the rotatable fixing belt 12, serving as a fixing member, contacts the rotatable pressing roller 13, serving as a pressing member, provided under the fixing belt 12 to form the fixing nip portion N between the fixing belt 12 and the pressing roller 13. The sub oil pan 22A1 is provided under the pressing roller 13 and contains oil O in which a part of the pressing roller 13 is dipped. The blade 22B is provided downstream from the sub oil pan 22A1 and upstream from the fixing nip portion N in the direction of rotation of the pressing roller 13, and serves as an oil regulating member for regulating an amount of oil O adhering to the pressing roller 13.

The oil pan 22A is fixed inside the fixing cover 100C (depicted in FIG. 4) of the fixing device 100, and includes two pans, which are the sub oil pan 22A1 serving as an oil pan for containing oil O in which a part of the pressing roller 13 is dipped and the main oil pan 22A2 serving as an oil receiver for holding the whole sub oil pan 22A1. Oil O to be applied to the pressing roller 13 is supplied from an outside of the oil applier 22 into the sub oil pan 22A1 and stored in the sub oil pan 22A1. The sub oil pan 22A1 has a rectangular shape. A long length of the sub oil pan 22A1 is equal to or longer than at least a long length (e.g., a width) of the pressing roller 13, that is, a length in a longitudinal direction (e.g., a width direction or an axial direction) of the pressing roller 13.

The pressing roller 13 is constantly dipped in oil O in the sub oil pan 22A1 wholly in the width direction (e.g., the axial direction) and partially in a diametrical direction (e.g., a direction perpendicular to the width direction) of the pressing roller 13. For example, an oil level of the sub oil pan 22A1 is higher than a lower end of the pressing roller 13 even when the pressure application-release device 30 (depicted in FIG. 5) presses the pressing roller 13 against the fixing belt 12. The lower end of the pressing roller 13 does not touch an inner bottom of the sub oil pan 22A1 even when pressure applied by the pressure application-release device 30 to the pressing roller 13 is released.

The main oil pan. 22A2 serves as an oil receiver for receiving oil O overflowing the sub oil pan 22A1. An outlet through which oil O is collected into the oil tank 251 depicted in FIG. 3 is provided under the main oil pan 22A2.

The sub oil pan 22A1 and the main oil pan 22A2 may include heat-resistant metal or plastic not reacting to oil O.

The blade 22B includes an elastic member having a paddle-like shape and has a width equal to or longer than at least the width of the pressing roller 13. A long edge of the blade 22B constantly contacts a surface of the pressing roller 13. In other words, a longitudinal direction of the blade 22B corresponds to the longitudinal direction (e.g., the width direction or the axial direction) of the pressing roller 13. Thus, the blade 22B regulates an amount of oil O adhering to the pressing roller 13 so that a reference amount of oil O is adhered to the pressing roller 13 uniformly in the width direction of the pressing roller 13. The blade 22B includes a material not damaging the surface of the pressing roller 13, such as fluorocarbon rubber.

The surface of the pressing roller 13 includes a material corresponding to oil O. For example, when silicon oil is used as oil O, the surface of the pressing roller 13 includes silicon rubber. Therefore, when the pressing roller 13 is dipped in oil o in the sub oil pan 22A1, the silicon rubber of the pressing roller 13 swells and holds oil O. The blade 22B contacts a lower surface of the pressing roller 13 to scrape oil O off the surface of the pressing roller 13. For example, an angle θ formed by a head of the blade 22B and a tangent line of the head of the blade 22B tangent to a curve of the pressing roller 13 is an acute angle smaller than about 90 degrees. The head of the blade 22B opposes the direction of rotation of the pressing roller 13 to scrape surplus oil O off the surface of the pressing roller 13 into the oil pan 22A. Accordingly, the surface of the pressing roller 13 carries a sufficient amount of oil O uniformly applied on the surface of the pressing roller 13 in the width direction of the pressing roller 13, which can provide proper property for separating a sheet P bearing a fixed toner image T from the pressing roller 13. Surplus oil O on the pressing roller 13 is collected into the oil pan 22A and reused. Namely, surplus oil O is circulated and applied to the pressing roller 13 again.

The cleaning felt 22C may be provided between the oil pan 22A and the blade 22B. The cleaning felt 22C serves as a cleaner for cleaning the surface of the pressing roller 13 by contacting the pressing roller 13. The cleaning felt 22C may be a compressed sheet including heat-resistant fiber not reacting to oil O, such as meta-aramid fiber. While oil O permeates the fiber of the cleaning felt 22C, the cleaning felt 22C captures fine solid impurities inside. Thus, fine solid impurities (e.g., dust and calcium carbonate originating from a sheet P) contained in oil O can be removed from the surface of the pressing roller 13, while the oil O remains on the surface of the pressing roller 13.

A support supports the cleaning felt 22C in such a manner that the cleaning felt 22C contacts the pressing roller 13. When the support is formed of a metal material by sheet metal processing to have proper spring property, the support causes the cleaning felt 22C to contact the pressing roller 13 while applying constant pressure to the pressing roller 13, so as to adjust an amount of oil O adhering to the pressing roller 13.

Figure 7:
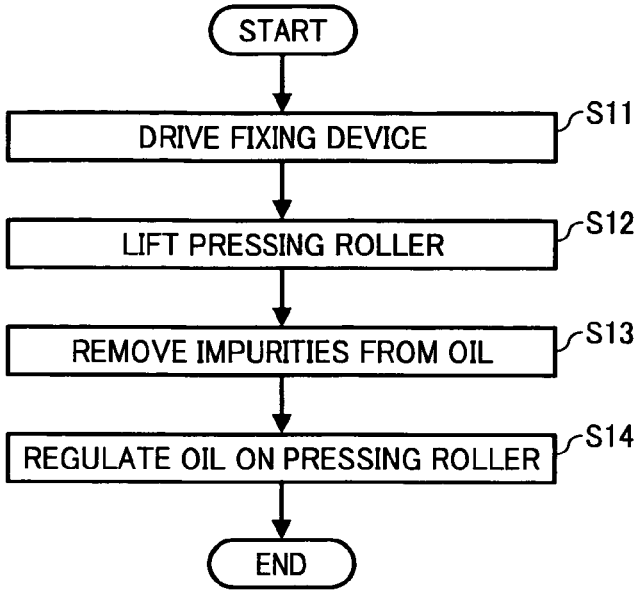
FIG. 7 is a flowchart (according to an example embodiment) illustrating a procedure for applying oil from the oil applier shown in FIG. 6 to a pressing roller included in the fixing device shown in FIG. 4.

Referring to FIGS. 5 to 7, the following describes a procedure for applying oil O from the oil applier 22 to the pressing roller 13 with the above-described structure. FIG. 7 is a flowchart illustrating the procedure for applying oil O from the oil applier 22 to the pressing roller 13.

In step S11, the controller 260 depicted in FIG. 3 starts driving the fixing device 100. Accordingly, the pressure application-release device 30 causes the pressing roller 13 to contact the fixing belt 12 by applying constant pressure to the fixing belt 12 to form the fixing nip portion N between the fixing belt 12 and the pressing roller 13. Simultaneously, the pressing roller 13 starts rotating, and the rotating pressing roller 13 rotates the fixing belt 12. Alternatively, the fixing roller 11 interlocked with the pressing roller 13 may rotate the fixing belt 12.

In step S12, when the pressing roller 13 starts rotating, the surface of the pressing roller 13 dipped in oil O in the sub oil pan 22A1 is lifted toward the fixing nip portion N in a state in which the oil O is adhered to the surface of the pressing roller 13.

In step S13, the oil O adhered to the surface of the pressing roller 13 permeates the cleaning felt 22C, and the cleaning felt 22C removes solid impurities from the oil O.

In step S14, the blade 22B regulates the oil O adhered to the surface of the pressing roller 13 uniformly in the width direction of the pressing roller 13. Thereafter, the regulated oil O on the surface of the pressing roller 13 moves to the fixing nip portion N.

As described above, according to this example embodiment, the oil applier 22 applies oil O to the pressing roller 13 provided under the fixing nip portion N in a dip method by utilizing a space under the pressing roller 13. Thus, the oil applier 22 can supply a sufficient amount of oil O to the pressing roller 13 stably.

Figure 8:
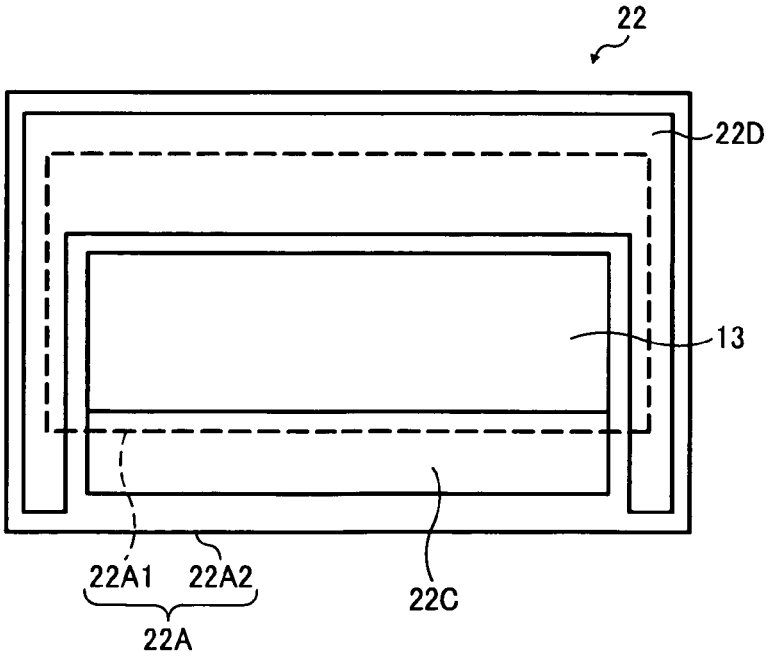
FIG. 8 is a top view (according to an example embodiment) of the oil applier shown in FIG. 6.

FIG. 8 is a top view of the oil applier 22. FIG. 8 does not illustrate the blade 22B. The oil applier 22 further includes an oil spatter prevention member 22D.

In FIG. 8, the oil spatter prevention member 22D covers an oil surface of oil O contained in the oil pan 22A. For example, the oil spatter prevention member 22D covers a region of the oil surface of oil O contained in the sub oil pan 22A1 and the main oil pan 22A2 of the oil pan 22A other than a region of the oil surface of oil O in which the pressing roller 13 is dipped. The oil spatter prevention member 22D may not cover a region of the oil surface of oil O provided under the cleaning felt 22C. Thus, the oil spatter prevention member 22D can reduce or prevent oil O spattering from the oil surface of oil O contained in the oil pan 22A due to rotation of the pressing roller 13 or other vibration and thereby adhering to and staining a sheet P or a peripheral device.

The oil spatter prevention member 22D may be a compressed sheet (e.g., a felt sheet) including heat-resistant fiber not reacting to oil O, such as meta-aramid fiber. The oil spatter prevention member 22D may float on the oil surface of oil O or may separate from the oil surface of oil O. Alternatively, the oil spatter prevention member 22D may include a plurality of spherical members floating on the oil surface of oil O to cover the oil surface of oil O.

As illustrated in FIG. 4, when driving of the fixing device 100 is interrupted after the fixing device 100 is driven, the pressure application-release device 30 (depicted in FIG. 5) separates the pressing roller 13 from the fixing belt 12 in the pressure release state, and the pressing roller 13 stops rotating. Thereafter, when driving of the fixing device 100 is resumed and an image forming job starts, oil O may adhere to and stain a sheet P passing through the fixing device 100.

In other words, when driving of the fixing device 100 is resumed, oil O may adhere to the separation nail 16B, and the oil 0 may adhere from the separation nail 16B to the sheet P. For example, when the fixing device 100 is driven, the oil applier 22 applies oil O to the pressing roller 13. When driving of the fixing device 100 is interrupted and the pressure application-release device 30 releases pressure applied to the pressing roller 13, oil O carried on the pressing roller 13 near the fixing nip portion N falls down along the surface of the pressing roller 13, and the oil O accumulates on a contact portion of the pressing roller 13, which contacts the blade 22B depicted in FIG. 6. When driving of the fixing device 100 is resumed, the pressing roller 13 presses against the fixing belt 12 again, and the separation nail 16B contacts the pressing roller 13. The rotating pressing roller 13 moves the accumulation portion of the pressing roller 13, on which the oil O is accumulated, toward the separation nail 16B, and the oil O is adhered to the separation nail 16B at a position at which the pressing roller 13 contacts the separation nail 16B. When the separation nail 16B contacts a sheet P passing through the fixing nip portion N during an image forming operation, the oil O is adhered from the separation nail 16B to the sheet P.

To address this, the fixing device 100 is controlled as described below, when driving of the fixing device 100 is resumed.

In the fixing device 100 illustrated in FIG. 4, in order to change the state of the pressing roller 13 from the pressure release state in which the pressing roller 13 separates from the fixing belt 12 to the pressure application state in which the pressing roller 13 presses against the fixing belt 12, the pressing roller 13 starts rotating while the pressing roller 13 separates from the fixing belt 12, and then the pressing roller 13 contacts the fixing belt 12 to press against the fixing belt 12.

Figure 9:
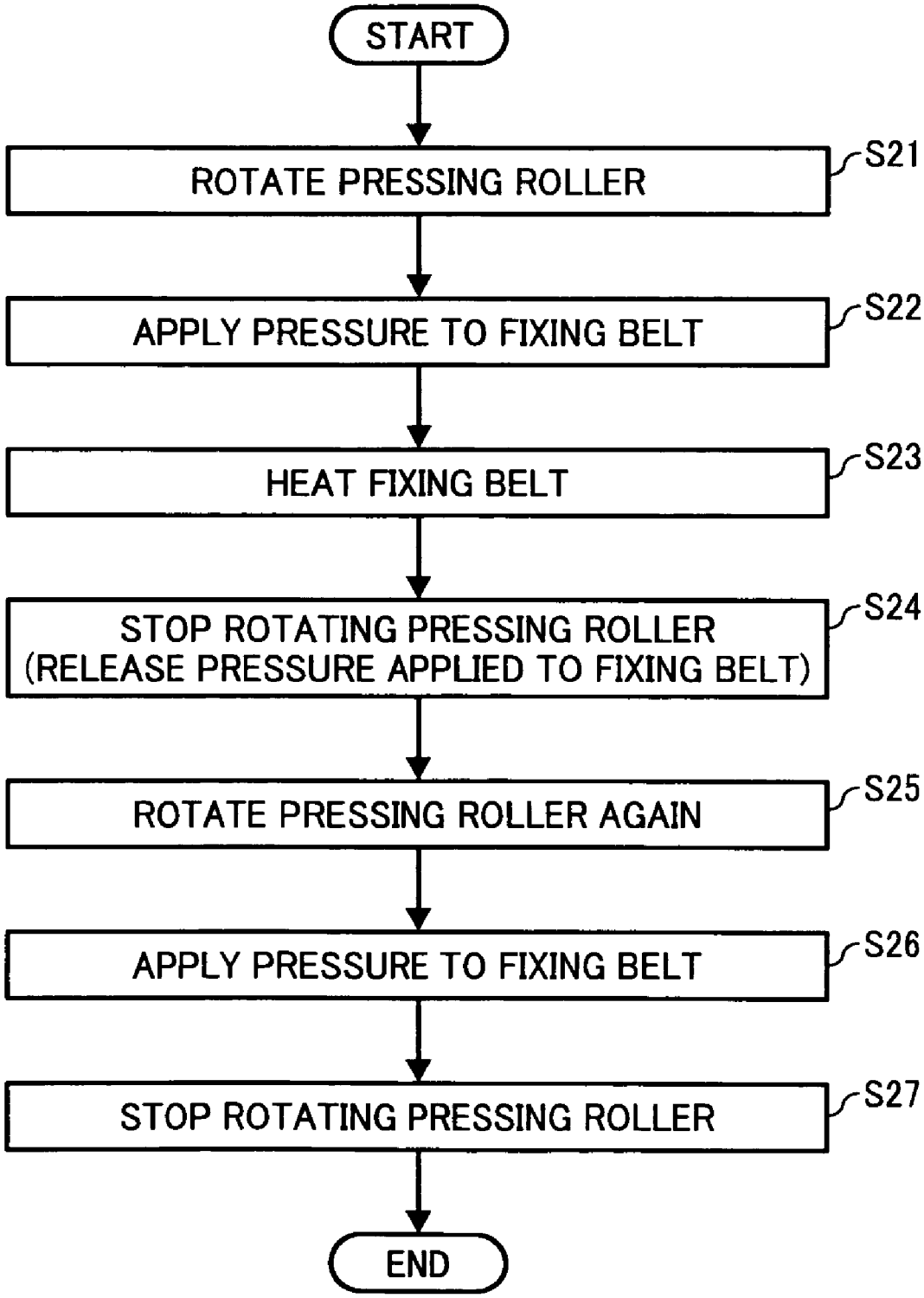
FIG. 9 is a flowchart (according to an example embodiment) illustrating a control procedure for changing a state of a pressing roller included in the fixing device shown in FIG. 4 from a pressure release state to a pressure application state.
Figure 10:
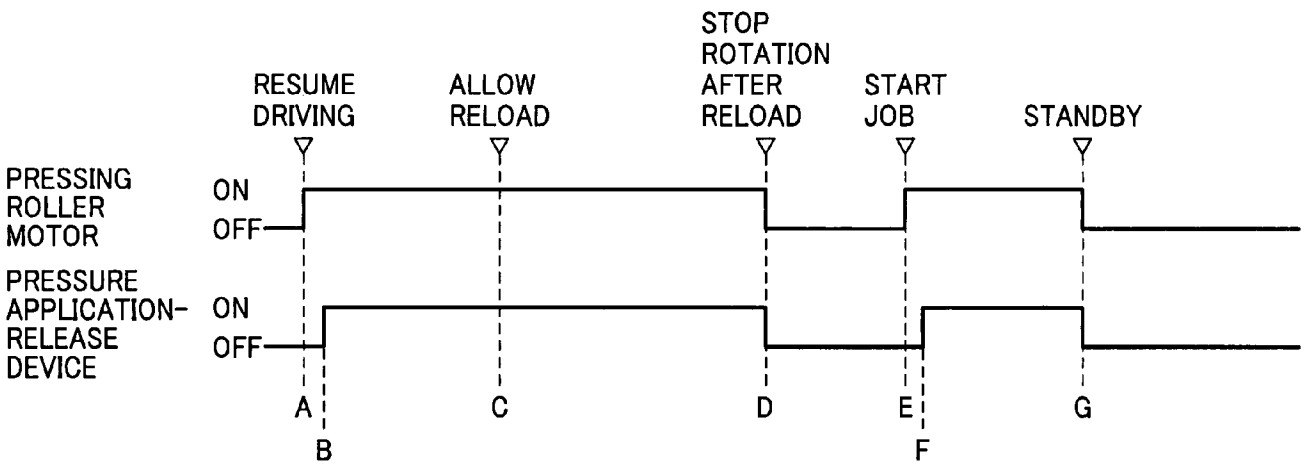
FIG. 10 is a timing chart (according to an example embodiment) illustrating the control procedure shown in FIG. 9.

FIG. 9 is a flowchart illustrating a control procedure for changing the state of the pressing roller 13 from the pressure release state to the pressure application state. FIG. 10 is a timing chart illustrating the control procedure for changing the state of the pressing roller 13 from the pressure release state to the pressure application state. The state of the pressing roller 13 changes from the pressure release state to the pressure application state when driving of the fixing device 100 is resumed and when an image forming operation is performed.

As illustrated in FIG. 9, in step S21, in order to resume driving of the fixing device 100 (depicted in FIG. 5) when driving of the fixing device 100 is interrupted after the fixing device 100 is driven, the controller 260 (depicted in FIG. 3) drives a motor for driving the pressing roller 13 (depicted in FIG. 5) at point A illustrated in FIG. 10 to rotate the pressing roller 13 by at least a half turn, preferably a turn, for at least 1 second.

In step S22, the controller 260 drives the pressure application-release device 30 (depicted in FIG. 5) to cause the pressing roller 13 to contact the fixing belt 12 (depicted in FIG. 5) in the pressure application state in which the pressing roller 13 presses against the fixing belt 12 at point B illustrated in FIG. 10.

In step S23, when rotation of the fixing belt 12 and the pressing roller 13 is stabilized in the pressure application state in which the pressing roller 13 presses against the fixing belt 12, the controller 260 allows reload to start heating the fixing belt 12 by the heater 14H of the heating roller 14 (depicted in FIG. 4) at point C illustrated in FIG. 10.

In step S24, when temperature of the fixing belt 12 reaches a reference temperature (e.g., a reload temperature), operations for resuming driving of the fixing device 100 are finished. For example, the controller 260 stops driving the motor for driving the pressing roller 13 to stop rotating the pressing roller 13, and causes the pressure application-release device 30 to release pressure applied by the pressing roller 13 to the fixing belt 12 at point D illustrated in FIG. 10.

In step S25, in order to start an image forming job, the controller 260 drives the motor for driving the pressing roller 13 again at point E to rotate the pressing roller 13 by at least a half turn, preferably a turn.

In step S26, the controller 260 drives the pressure application-release device 30 to cause the pressing roller 13 to contact the fixing belt 12 in the pressure application state in which the pressing roller 13 presses against the fixing belt 12 at point F illustrated in FIG. 10.

In step S27, when the image forming job is finished, that is, when a fixing process for fixing a toner image T on a sheet P passing through the fixing nip portion N is finished, the controller 260 stops driving the motor for driving the pressing roller 13, and causes the pressure application-release device 30 to release pressure applied by the pressing roller 13 to the fixing belt 12 at point G illustrated in FIG. 10 in a standby mode.

As illustrated in FIG. 4, with the above-described control procedure, the accumulation portion of the pressing roller 13 bearing oil O accumulated at a position at which the pressing roller 13 contacts the blade 22B (depicted in FIG. 6) passes through a position at which the pressing roller 13 is to contact the separation nail 16B before the separation nail 16B contacts the pressing roller 13. Further, the surface of the pressing roller 13 bearing oil O reaches the position at which the separation nail 16B contacts the pressing roller 13 after the blade 22B adjusts an amount of oil O on the pressing roller 13. Therefore, surplus oil O may not adhere to the separation nail 16B, reducing or preventing oil O adhering to a sheet P.

Figure 11B:
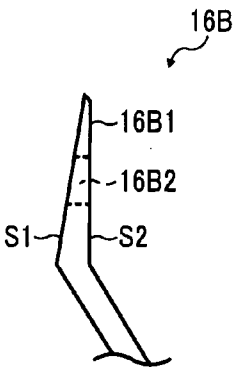
FIG. 11B is a sectional view (according to an example embodiment) of the separation nail shown in FIG. 11A.
Figure 11A:
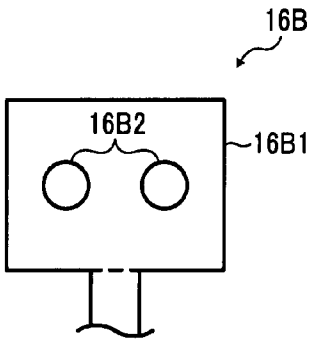
FIG. 11A is a top view (according to an example embodiment) of a separation nail included in the fixing device shown in FIG. 4.

FIG. 11A is a top view of the separation nail 16B. FIG. 11B is a sectional view of the separation nail 16B. The separation nail 16B includes a nail member 16B1 and/or a through-hole 16B2.

The nail member 16B1 contacts the pressing roller 13 depicted in FIG. 4. Oil O passes through the through-hole 16B2 from a surface S1 of the nail member 16B1, that is, a non-contact surface not contacting the pressing roller 13 to face the discharge path for discharging a sheet P out of the fixing device 100, to an opposite surface S2 of the nail member 16B1, that is, a contact surface provided opposite the non-contact surface to contact the pressing roller 13. A plurality of the separation nails 16B is distributed in the width direction of the pressing roller, 13. Thus, even when surplus oil O adhering to the pressing roller 13 moves to the separation nail 16B, the surplus oil O is discharged from the surface S1 of the nail member 16B1 through the through-hole 16B2, reducing or preventing the surplus oil O adhering to the sheet P.

Figure 12:
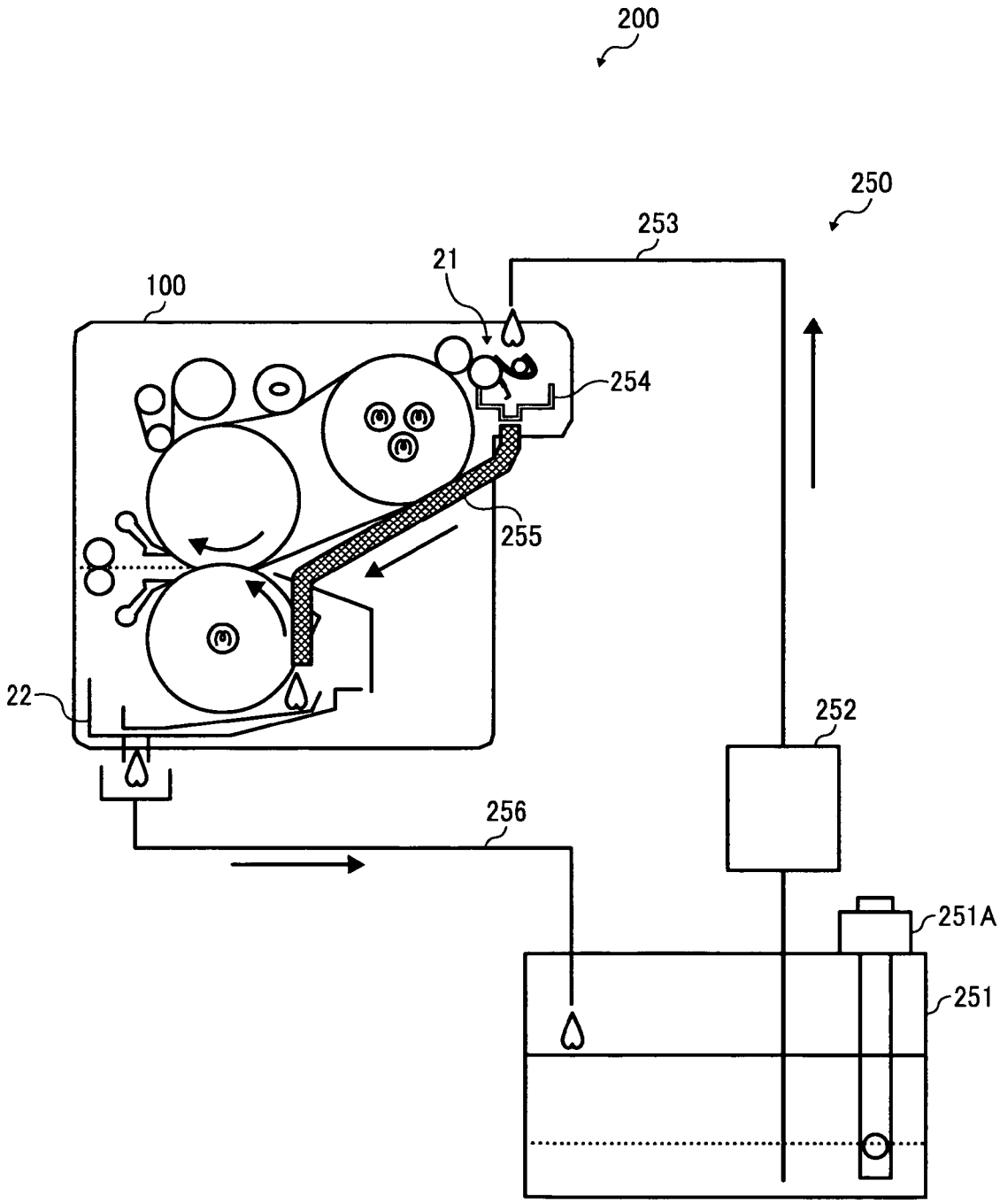
FIG. 12 is a schematic view (according to an example embodiment) of an oil circulation system included in the image forming apparatus shown in FIG. 3.

Referring to FIG. 12, the following describes the oil circulation mechanism 250, serving as an oil circulation system, included in the image forming apparatus 200. FIG. 12 is a schematic view of the oil circulation mechanism 250. The oil circulation mechanism 250 further includes a conveyance path 253, an oil receiver 254, a tube 255, and/or a conveyance path 256. The oil tank 251 includes an oil sensor 251A.

The oil tank 251 contains oil to be used in the fixing device 100. The oil pump 252 uses a piezoelectric element. The conveyance path 253 connects the oil pump 252 to the oil applier 21 of the fixing device 100. The oil receiver 254 receives surplus oil sent from the oil applier 21. The tube 255 conveys the oil sent from the oil receiver 254 to the oil applier 22. The conveyance path 256 connects the oil applier 22 to the oil tank 251. The oil tank 251, the oil pump 252, and the conveyance paths 253 and 256 are disposed outside the fixing device 100. The oil receiver 254 and the tube 255 are disposed inside the fixing device 100. The oil sensor 251A detects an amount of oil remaining in the oil tank 251.

In the image forming apparatus 200, the oil circulation mechanism 250 circulates oil as described below so that the oil appliers 21 and 22 sequentially apply oil to the fixing belt 12 and the pressing roller 13 depicted in FIG. 4, respectively.

For example, when an image forming operation starts, the oil pump 252 pumps silicon oil from the oil tank 251, which stores a total volume of about 4 liters of silicon oil, and conveys the oil to the oil applier 21 through the conveyance path 253. For example, the oil is put into the oil applier 21 at a supply speed of about 3 grams per minute.

The oil receiver 254 collects surplus oil from the oil applier 21. The surplus oil is conveyed to the sub oil pan 22A1 of the oil applier 22 provided for the pressing roller 13 (depicted in FIG. 6) through the tube 255.

Oil used in the oil applier 22 is filtered by a filter to remove impurities, and is collected into the oil tank 251 through the conveyance path 256.

As illustrated in FIG. 6, in a fixing device (e.g., the fixing device 100) according to the above-described example embodiments, a pressing member (e.g., the pressing roller 13) is dipped in oil (e.g., oil O) contained in an oil pan (e.g., the sub oil pan 22A1) to adhere oil to the pressing member. Thus, a sufficient amount of oil can be stably applied to the pressing member provided under a fixing nip portion (e.g., the fixing nip portion N), maintaining improved property for separating a recording medium (e.g., a sheet P) from the pressing member.

When driving of the fixing device stops, the pressing member separates from a fixing member (e.g., the fixing belt 12), and thereby does not apply pressure to the fixing member. Accordingly, oil accumulates on a contact portion on the pressing member, which contacts an oil regulating member (e.g., the blade 22B). However, the control procedure according to the above-described example embodiments, which is performed when the fixing device is driven, can reduce or prevent accumulation of oil on the pressing member and resultant adhesion of the oil to a recording medium.

According to the above-described example embodiments, an image forming apparatus (e.g., the image forming apparatus 200 depicted in FIG. 3) including the fixing device can provide improved fixing and separation functions, and therefore can handle various types of paper, such as thin paper and thick paper, and various types of image formation, such as a narrower top margin on a sheet. Further, the image forming apparatus can reduce or prevent adhesion of oil to a recording medium, when driving of the fixing device is resumed or when an image forming operation starts.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device, comprising:

a rotatable fixing member;

a rotatable pressing member provided under the fixing member;

a controller to switch the pressing member between a pressure application state to contact the pressing member against the fixing member and a pressure release state to separate the pressing member from the fixing member, the controller starting rotation of the pressing member before the pressing member contacts the fixing member in the pressure application state, when the pressing member switches from the pressure release state to the pressure application state; and an oil applier, the oil applier including:

an oil pan provided under the pressing member to contain oil in which the pressing member is lowered into the oil pan to be dipped thereof; and an oil regulating member provided downstream from the oil pan in a direction of rotation of the pressing member to contact the pressing member to regulate an amount of oil adhering to the pressing member.

2. The fixing device according to claim 1, wherein the pressing member rotates by at least a half turn before contacting the fixing member in the pressure application state, when the pressing member switches from the pressure release state to the pressure application state.

3. The fixing device according to claim 1, further comprising:

a separation nail to contact the pressing member when the pressing member contacts the fixing member in the pressure application state, the separation nail comprising:

a nail member to contact the pressing member; and a through-hole provided in the nail member through which oil passes from a non-contact surface of the nail member that does not contact the pressing member to a contact surface of the nail member provided opposite the non-contact surface to contact the pressing member.

4. The fixing device according to claim 1, wherein the oil pan includes:

a sub-oil pan serving as an oil pan for containing oil in which part of the pressing member is dipped; and a main oil pan serving as an oil receiver for oil overflowing from the sub-oil pan.

5. The fixing device according to claim 1, further comprising another oil applier to be applied to a fixing belt.

6. The fixing device according to claim 1, wherein the oil regulating member is a blade, the blade includes an elastic member.

7. The fixing device according to claim 1, further comprising a cleaning felt upstream of the oil regulating member in a direction of rotation of the pressing member.

8. The fixing device according to claim 1, further comprising a pressure application-release device disposed adjacent to the pressing member to switch a state of the pressing member between a pressure application state in which the pressing member contacts the fixing member to apply pressure thereof and a pressure release state in which the pressing member separates from the fixing member to release pressure applied to the fixing member.

9. The fixing device according to claim 8, wherein the pressure application-release device includes a pressing cam, a first pressing arm, a second pressing arm, an elastic member, and a support shaft.

10. An image forming apparatus, comprising:

a fixing device including:

a rotatable fixing member;

a rotatable pressing member provided under the fixing member;

a controller to switch the pressing member between a pressure application state to contact the pressing member against the fixing member and a pressure release state to separate the pressing member from the fixing member, the controller starting rotation of the pressing member before the pressing member contacts the fixing member in the pressure application state, when the pressing member switches from the pressure release state to the pressure application state; and an oil applier, the oil applier including:

an oil pan provided under the pressing member to contain oil in which the pressing member is lowered into the oil pan to be dipped thereof; and an oil regulating member provided downstream from the oil pan in a direction of rotation of the pressing member to contact the pressing member to regulate an amount of oil adhering to the pressing member.

11. The image forming apparatus according to claim 10, wherein the pressing member rotates by at least a half turn before contacting the fixing member in the pressure application state, when the pressing member switches from the pressure release state to the pressure application state.

12. The image forming apparatus according to claim 10, wherein the fixing device further comprises a separation nail to contact the pressing member when the pressing member contacts the fixing member in the pressure application state, the separation nail comprising:

a nail member to contact the pressing member; and a through-hole provided in the nail member through which oil passes from a non-contact surface of the nail member that does not contact the pressing member to a contact surface of the nail member provided opposite the non-contact surface to contact the pressing member.

13. The image forming apparatus according to claim 10, wherein the oil pan includes:

a sub-oil pan serving as an oil pan for containing oil in which part of the pressing member is dipped; and a main oil pan serving as an oil receiver for oil overflowing from the sub-oil pan.

14. The image forming apparatus according to claim 10, further comprising another oil applier to be applied to a fixing belt.

15. The image forming apparatus according to claim 10, wherein the oil regulating member is a blade, the blade includes an elastic member.

16. The image forming apparatus according to claim 10, further comprising a cleaning felt upstream of the oil regulating member in a direction of rotation of the pressing member.

17. The image forming apparatus according to claim 10, further comprising a pressure application-release device disposed adjacent to the pressing member to switch a state of the pressing member between a pressure application state in which the pressing member contacts the fixing member to apply pressure thereof and a pressure release state in which the pressing member separates from the fixing member to release pressure applied to the fixing member.

18. The image forming apparatus according to claim 17, wherein the pressure application-release device includes a pressing cam, a first pressing arm, a second pressing arm, an elastic member, and a support shaft.

19. An image fixing method, comprising:

lowering a pressing member into an oil pan to be dipped thereof;

applying oil to the pressing member;

regulating an amount of oil adhering to the pressing member;

contacting the pressing member against a fixing member after the pressing member rotates by at least a half turn;

contacting a separation nail against the pressing member when the pressing member contacts the fixing member; and switching the pressing member between a pressure application state, in which the pressing member is contacted against the fixing member, and a pressure release state, in which the pressing member is separated from the fixing member.

* * * * *

UNITED STATES PATENT AND TRADEMARK OFFICE

CERTIFICATE OF CORRECTION

PATENT NO. : 8,112,022 B2
APPLICATION NO. : 12/453189
DATED : February 7, 2012
INVENTOR(S) : Okamoto et al.

It is certified that error appears in the above-identified patent and that said Letters Patent is hereby corrected as shown below:

Title page should read

Item (75) Inventors: Masami Okamoto, Yamato (JP); Jun Okamoto, Kawasaki (JP); Kazuo Suno, Mito (JP); Kenji Nozawa, Hitachinaka (JP); Naoto Suzuki, Hitachinaka (JP); Yoshihiro Sonohara, Hitachi (JP); Syoichi Kaneko, Ishioka (JP); Takashi Kagami, Mito (JP); Keisuke Kubota, Hitachinaka (JP); Hiroyuki Shimada, Zama (JP)

Signed and Sealed this
Fifteenth Day of May, 2012

David J. Kappos

David J. Kappos
*Director of the United States Patent and Trademark Office*